US005207052A

United States Patent [19]

Fink et al.

[11] Patent Number: 5,207,052

[45] Date of Patent: May 4, 1993

[54] METHOD OF TRANSPORTING AND POSITIONING A SET OF YARN PACKAGES IN A SPINDLE ASSEMBLY OF A TWISTER YARN PROCESSING MACHINE AND AN ADAPTER DEVICE FOR USE THEREIN

[75] Inventors: Heinz Fink, Krefeld; Heinz Stenmans, Grefrath, both of Fed. Rep. of Germany

[73] Assignee: Palitex Project Company GmbH, Krefeld, Fed. Rep. of Germany

[21] Appl. No.: 834,942

[22] Filed: Feb. 13, 1992

Related U.S. Application Data

[62] Division of Ser. No. 465,769, Jan. 16, 1990, abandoned.

[30] Foreign Application Priority Data

Jan. 21, 1989 [DE] Fed. Rep. of Germany ..... 3901771

[51] Int. Cl.[5] ..... D01H 9/18

[52] U.S. Cl. ..... 57/279; 57/58.52; 57/281

[58] Field of Search ..... 57/279, 281, 276, 278, 57/58.52; 242/1

[56] References Cited

U.S. PATENT DOCUMENTS

| | | | |
|---|---|---|---|
| 3,924,395 | 12/1975 | Grossi . | |
| 4,127,983 | 12/1978 | Munker . | |
| 4,355,500 | 10/1982 | Yanobu et al. . | |
| 4,377,065 | 3/1983 | Yanobu . | |
| 4,453,377 | 6/1984 | Inger et al. . | |
| 4,569,189 | 2/1986 | Frentzel-Beyme . | |
| 4,628,686 | 12/1986 | Tone et al. . | |
| 4,711,081 | 12/1987 | Frentzel-Beyme et al. . | |
| 4,848,077 | 7/1989 | Kawarabashi et al. . | |
| 4,928,476 | 5/1990 | Otoshima et al. | 57/281 X |
| 4,979,360 | 12/1990 | Kallmann et al. . | |
| 5,020,735 | 6/1991 | Inger et al. | 242/1 |
| 5,062,261 | 11/1991 | Fink | 57/281 |
| 5,082,192 | 1/1992 | Langen et al. | 242/1 X |
| 5,136,833 | 8/1992 | Inger | 57/278 X |

FOREIGN PATENT DOCUMENTS

| | | |
|---|---|---|
| 3235442 | 9/1982 | Fed. Rep. of Germany . |
| 3742348 | 12/1987 | Fed. Rep. of Germany . |
| 3802900 | 2/1988 | Fed. Rep. of Germany . |
| 3811667 | 4/1988 | Fed. Rep. of Germany . |
| 3824998 | 7/1988 | Fed. Rep. of Germany . |
| 63-247273 | 10/1988 | Japan . |

*Primary Examiner*—Joseph J. Hail, III

*Attorney, Agent, or Firm*—Bell, Seltzer, Park & Gibson

[57] ABSTRACT

A method for transporting a set or stack of yarn packages comprising at least yarn packages to a twisting machine as well as an apparatus for carrying out said method. The yarn ends of the packages are arranged in the interior of the hollow center of the package before the transportation. The yarn packages are creeled on a common, tubular adapter, which is provided on its upper end with a gripping head for engagement with a gripper and/or the transport element of a conveying system. Then the yarn ends F1 and F2 are arranged in the interior of the adapter and held therein during the entire transportation until the set of yarn packages is inserted into a spindle of the twisting machine. Once the set of yarn packages is inserted into the spindle, a yarn unwinding head permitting the entry of the yarns is added, and the yarn ends are guided through this unwinding head into the spindle.

10 Claims, 9 Drawing Sheets

METHOD OF TRANSPORTING AND POSITIONING A SET OF YARN PACKAGES IN A SPINDLE ASSEMBLY OF A TWISTER YARN PROCESSING MACHINE AND AN ADAPTER DEVICE FOR USE THEREIN

This application is a divisional of application Ser. No. 07/465,769, filed on Jan. 16, 1990.

FIELD OF THE INVENTION

This invention relates to a method of transporting to and positioning a set of at least two yarn packages in a spindle assembly of a textile yarn processing machine while maintaining the yarn ends of the packages in desired locations, and an adapter device constructed for use in such method.

BACKGROUND OF THE INVENTION

When transporting yarn packages to yarn producing or yarn processing machines, considerable attention must be paid to the arrangement and location of the yarn ends of the packages. This is necessary both for the further processing of the yarn packages on the next working position and for safety reasons, since under circumstances falling yarn ends considerably impede an automated transportation.

It is known in the transportation of individual yarn packages, for example spinning bobbins, to locate the yarn end lying on the outer circumference of the bobbin and to arrange same in the interior of the bobbin core before the transportation (see, ZB-BE-OS 32 35 442 and DE-OS 37 42 348). In the case of twisting machines, frequently several packages with a single yarn wound thereon are supplied to each twisting position, it being necessary to pay attention to the location of the yarn ends on each individual package.

It is also known to combine several yarn packages to be supplied to a twisting machine to a set of packages, the individual yarn packages being interconnected by means of a clips connection known per se.

OBJECTS AND SUMMARY OF THE INVENTION

It is the object of the present invention to create a method of the initially described kind, which allows to transport a set of yarn packages comprising at least two packages to a twisting machine, and which further permits the yarn ends of all packages to assume a defined, fixed location in all stages of the transportation, so that on the one hand no yarn ends drop during the transportation and that on the other hand all yarn ends can be grasped jointly and automatically at the end of the transportation, thus enabling an operable feed of the yarn ends in the further processing.

Another object is to create an apparatus for carrying out the aforesaid method.

These objects are accomplished according to the present invention by providing a method of transporting to and positioning a set of at least two yarn packages in a spindle assembly of a twister textile yarn processing machine while maintaining the yarn ends of the packages in desired locations. The method includes the steps of creeling at a preparatory station at least two yarn packages on a tubular adapter device having at its upper end a gripping head, positioning the yarn ends of the packages in the interior of the adapter device at the preparatory station, conveying the adapter device and the yarn packages by the conveyor mechanism to a desired spindle assembly of a twister while the yarn ends remain in the interior of the adapter device, gripping the adapter device with a gripper device, moving the adapter device and the yarn packages from the conveyor mechanism and placing the adapter device and yarn packages on the spindle of the spindle assembly of the twister while the yarn ends remain in the interior of the adapter device, and threading the yarn ends from the interior of the adapter device through the spindle assembly for processing the yarn as it is withdrawn from the packages on the adapter device.

In one embodiment, the method further includes gripping the adapter device with a first gripper device at the preparatory station, moving the adapter device and the yarn packages and placing the adapter device and yarn packages on a holder device of a conveyor mechanism while the yarn ends remain in the interior of the adapter device. The step of gripping the adapter device after it has been conveyed by the conveying mechanism to the desired spindle assembly is performed with a second gripper device.

In a second embodiment, the step of creeling at least two yarn packages on a tubular adapter device at a preparatory station further includes positioning such adapter device at its lower end on an upstanding pin of a transport plate movably carried in a conveyor mechanism so that the transport plate, adapter device and yarn packages may be conveyed away from the preparatory station by the conveying mechanism and to the desired spindle assembly of the twister.

An adapter device is provided for mounting at least two packages of textile yarn for the above described preparatory processing, transporting and mounting in a spindle assembly of a twister yarn processing machine. Such adapter device comprises a tubular body portion open on both ends and being of sufficient length for receiving at least two superimposed yarn packages, an outwardly extending flange portion on the lower end of said body portion for supporting the yarn packages, and a head piece forming the upper end of said body portion and having a groove extending circumferentially around the outer surface thereof for being gripped by a gripper device. The head piece preferably includes an inwardly directed projection on the interior surface thereof for engagement with a coupling member of a suspension holder of a transporting conveyor mechanism.

In one embodiment, the open upper end of the tubular body portion at the head piece comprises a yarn entry channel for positioning the free ends of the yarn packages into the interior of the adapter device during transportation of the adapter device and yarn packages. In another embodiment, the head piece of the adapter device includes an opening in the side wall thereof for inserting the free ends of the yarn packages into the interior of the adapter device. There may also be provided a yarn channel extending from the yarn entry opening in the side wall of the head piece and in the circumferential direction of the wall over a predetermined angle of the circumference of the body portion, and a second opening in the side wall of the body portion and connecting with the yarn channel for receiving a suction nozzle when threading of the yarn ends therethrough is desired. The yarn channel extending from the yarn entry opening in the outside wall of the body portion may also extend downwardly in the wall of the head piece and terminate in the interior of the tubular body or extend the full length of the tubular body to terminate in a second opening in the lower end of the body portion for receiving a suction nozzle to apply suction to the yarn channel when threading of the yarn ends is desired.

The basic concept of the method of the present invention consists in that the yarn packages combined to a set or stack are interconnected by means of a package transport adapter, which is designed and constructed such that it is not removed from the set of packages upon completion of the transportation, but also interconnects the yarn packages forming the set or stack, while they are processed. This procedure makes it possible to arrange the yarn ends of all packages of the set in the interior of the package transport adapter before the transportation and to hold them therein until the set of packages is inserted into the spindle of the twisting machine. In this manner, it is made possible that, irrespective of the individual stations of the transportation and the type of conveying system used, the yarn ends of the packages do not change their common, defined location.

BRIEF DESCRIPTION OF THE DRAWINGS

Embodiments of the method of the present invention as well as apparatus for carrying out said method will be described in more detail hereinbelow with reference to the drawings, in which.

DETAILED DESCRIPTION OF THE PREFERRED EMBODIMENTS OF THE INVENTION

Figure 1:
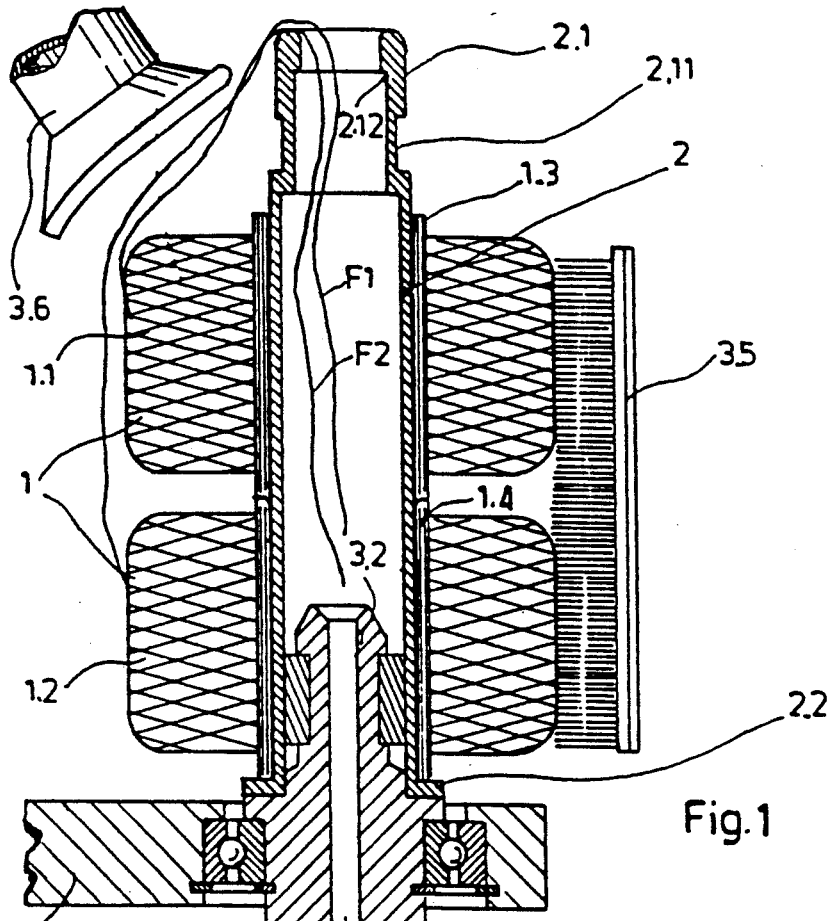
FIG. 1 is a vertical sectional view of a set of yarn packages comprising two packages on a preparatory device.

FIG. 1 illustrates two cross-wound packages of single yarns, which are combined to a set or stack and form as a pair the feed yarn package of a two-for-one twisting spindle.

To prepare a set of yarn packages, the two packages 1.1 and 1.2 are creeled with their hollow centers 1.3 and 1.4 on a package transport adapter 2, which is provided at its lower end with a flange 2.2 to accommodate the hollow center 1.4 of the lower yarn package. At its upper end the adapter 2 is provided with a head piece 2.1, which has a groove 2.11 extending over its outer circumference for engagement with a package gripper, as will be described hereinbelow. On its inner side below its upper edge, the head piece 2.1 is further provided with an inwardly directed projection 2.12 for engagement with a coupling member of an overhead conveyor, as will likewise be described hereinbelow.

As can be seen in FIG. 1, the set of yarn packages 1 comprising the two packages 1.1 and 1.2 is creeled together with the adapter 2 on a hollow pin 3.2 of a preparatory device 3. The hollow pin 3.2 is rotatably supported on the basic frame 3.1 of the preparatory device 3 and driven by a round cord drive 3.3. A suction nozzle 3.4 can be applied to the lower end of the hollow pin 3.2. In the preparatory station 3, the yarns ends F1 and F2 are brushed by a brush 3.5, grasped by a suction device 3.6 and guided over the upper end of head piece 2.1. The effect of the suction nozzle 3.4, which is applied to the lower end of the hollow pin 3.2 allows to suck the yarn ends, as is shown in FIG. 1, into the interior of the package transport adapter 2, where they remain during the entire transportation, as will be described hereinbelow.

Figure 2:
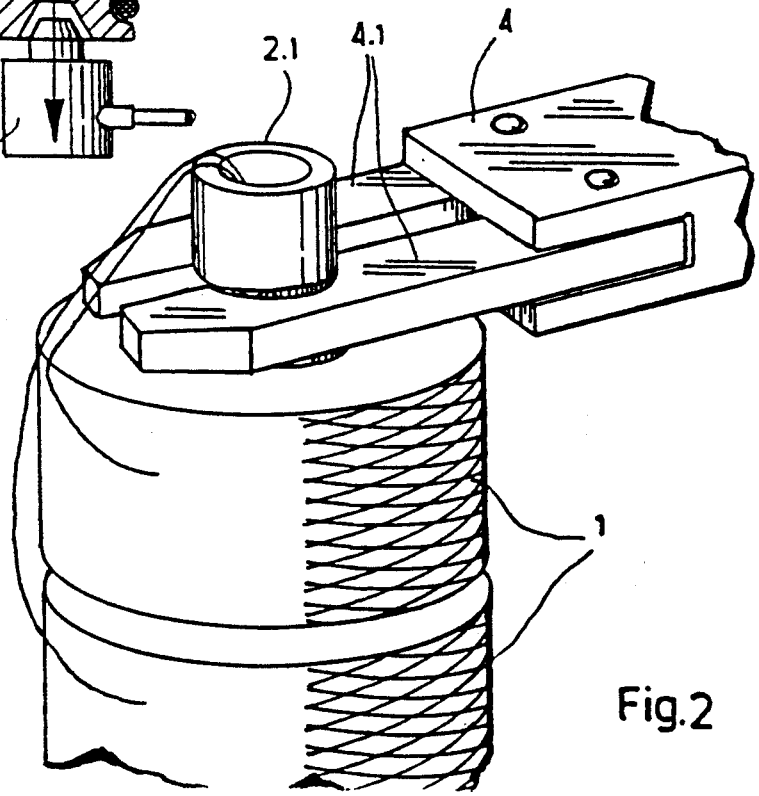
FIG. 2 is a perspective, partial view of the set of yarn packages of FIG. 1, after a package gripper is applied.
Figure 3:
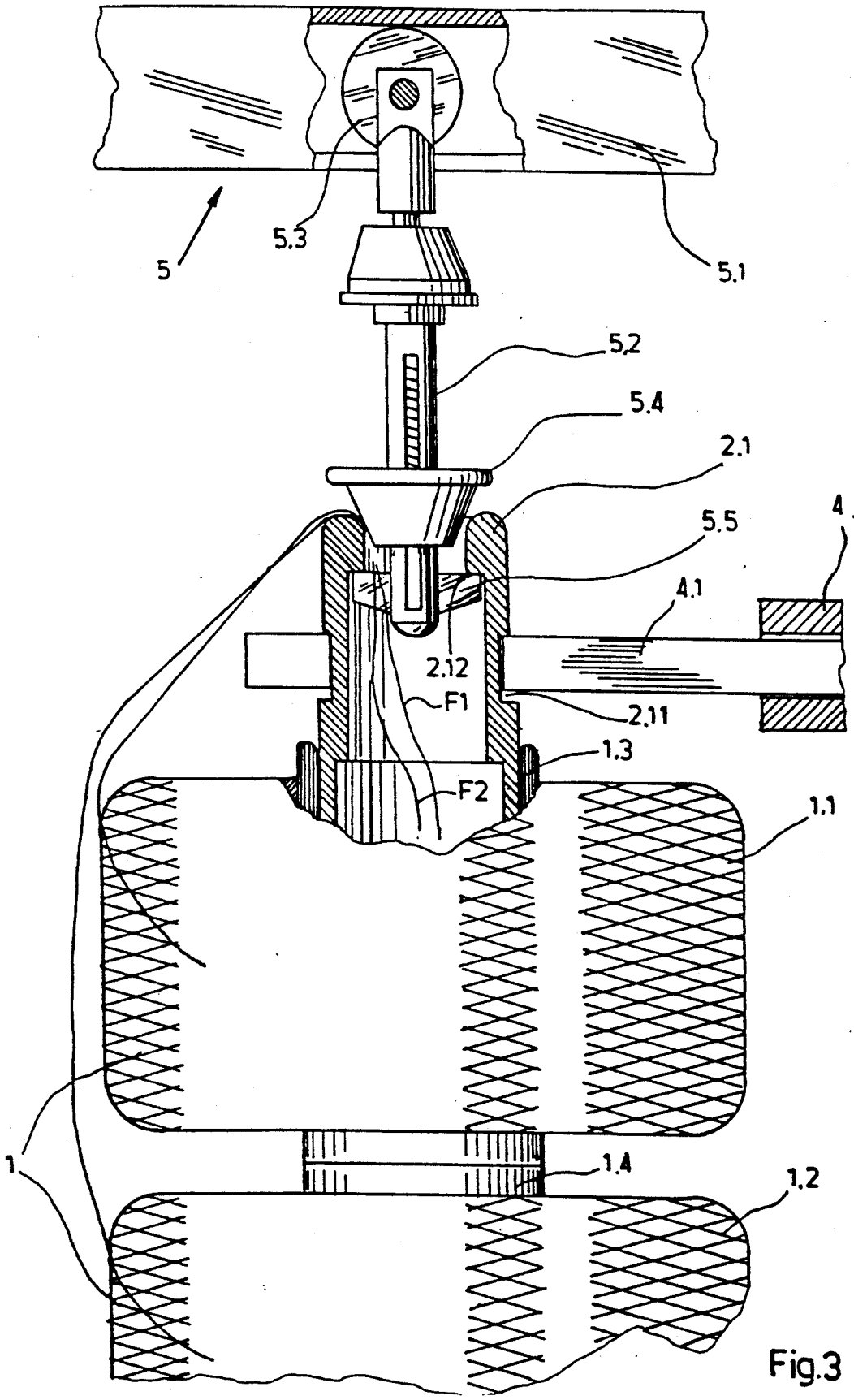
FIG. 3 is a side view, partially cut, of the set of yarn packages of FIGS. 1 and 2 as it is transferred to a conveying system.

Illustrated in FIG. 2 is the removal of set of yarn packages 1 from the hollow pin 3.2 of the preparatory device 3 by means of a gripper 4. In so doing, the gripping members 4.1 of the package gripper 4 engage with the groove 2.11 of the adapter 2. While being held by the gripper 4, the set of packages 1 is hung in a suspension holder 5.2, which forms a part of an overhead conveying system 5. The package holder 5.2 possesses at its lower end a coupling member 5.5, which engages behind the projection 2.12 in the head piece 2.1 of adapter 2. The yarn ends F1 and F2 extending over the upper edge of the head piece 2.1 are additionally clamped on the head 2.1 by a cone 5.4 arranged on package holder 5.2. The package holder 5.2 travels on rolls 5.3 along a transport rail 5.1 of the conveying system 5.

After engaging the set of yarn packages 1 With holder 5.2, the package gripper 4 disengages from adapter 2.

Figure 4:
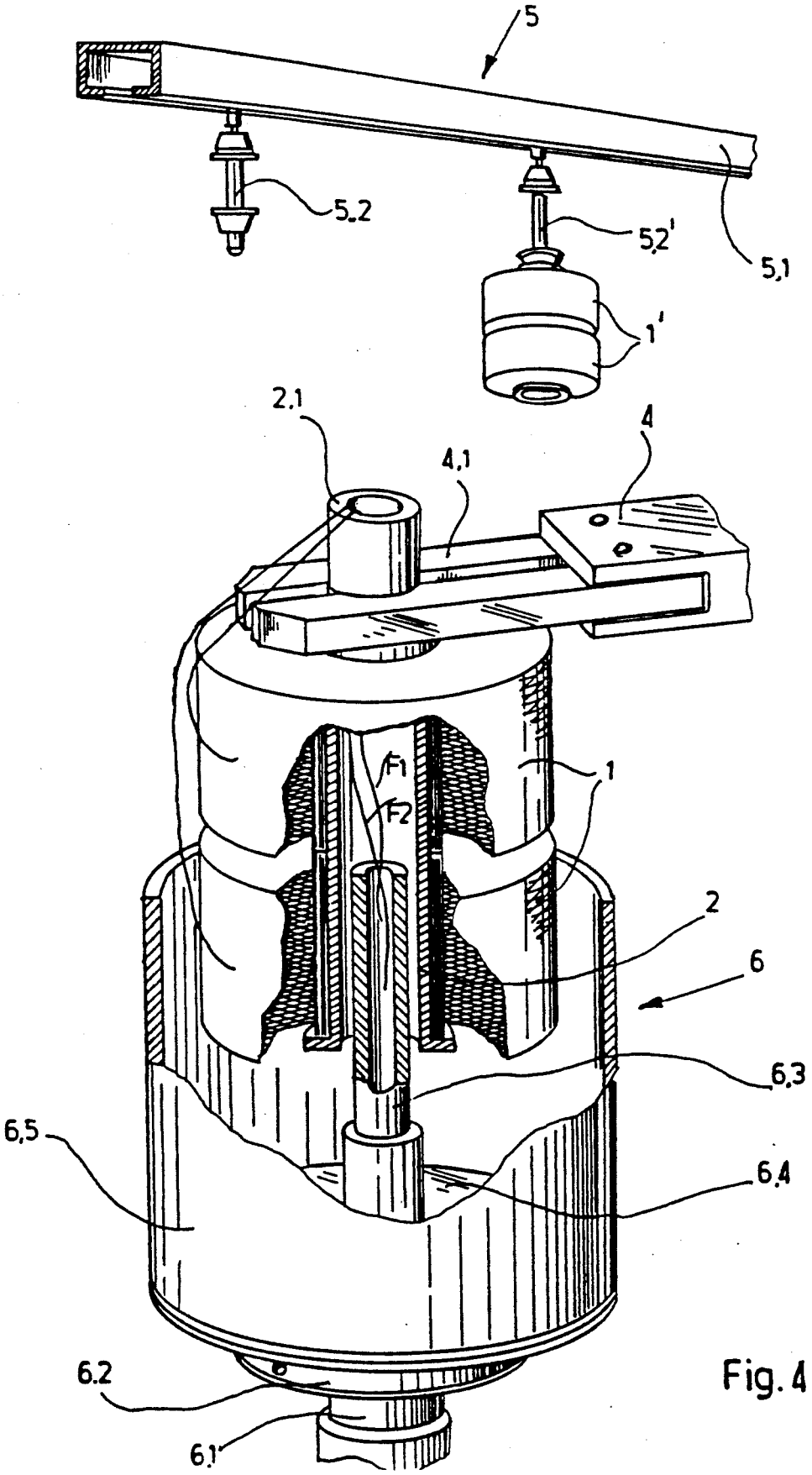
FIG. 4 is a perspective view of the set of yarn packages of FIGS. 1–3 after its removal from a conveying system and during its insertion into a two-for-one twisting spindle.

Shown in FIG. 4 is on the one hand a rail section 5.1 of the conveying system 5 with an empty bobbin holder 5.2 traveling along same, from which the gripper 4 has already removed the set of yarn package 1. Also shown, in the Figure is a second set of yarn packages 1' suspending from a holder 5.2'.

The gripper 4 which engages with its arms 4.1 on the head piece 2.1, inserts the set of yarn packages 1 meanwhile removed from the holder 5.2 into a two-for-one twisting spindle 6.

As is known, a two-for-one twisting spindle comprises a whorl 6.1, a rotating plate 6.2 with a yarn storage disk, a protective pot 6.5 with a bottom 6.4, the latter accommodating a hollow pin 6.3 axially arranged therein, on which the adapter 2 with a set of yarn packages 1 is creeled. Arranged in the hollow pin 6.3 is an injector not shown here, which sucks the yarn ends F1 and F2 into the interior of the spindle. Once the set of yarn packages held by the adapter is inserted, the package gripper 4 disengages from the adapter 2.

A gripper device and a conveying mechanism may be utilized of the type illustrated in U.S. Pat. No. 4,979,360, assigned to the assignee of the present application, which is incorporated herein by reference.

Figure 5:
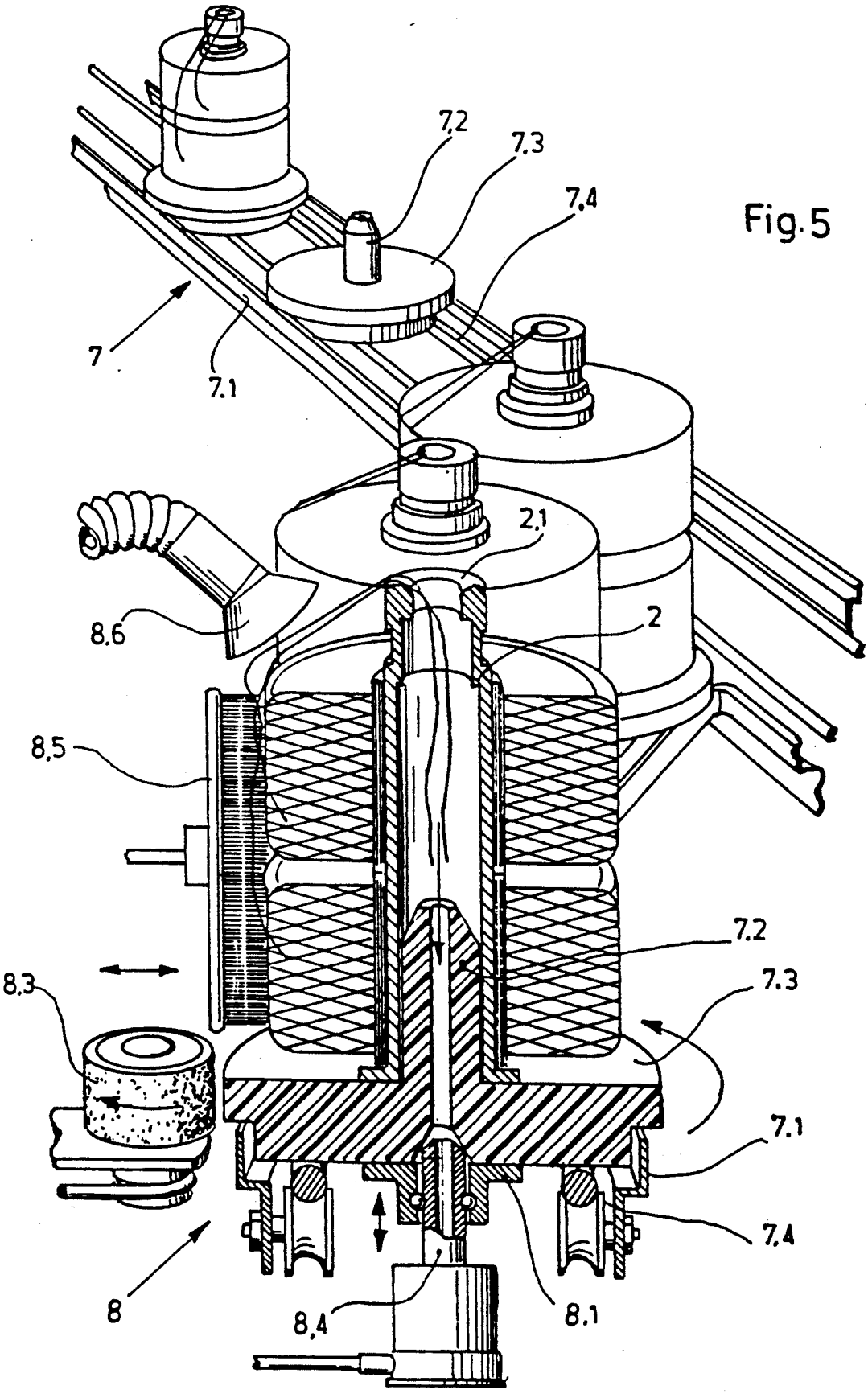
FIG. 5 is a perspective view, partially cut, of a set of yarn packages in a preparatory device integrated in another conveying system.
Figure 6:
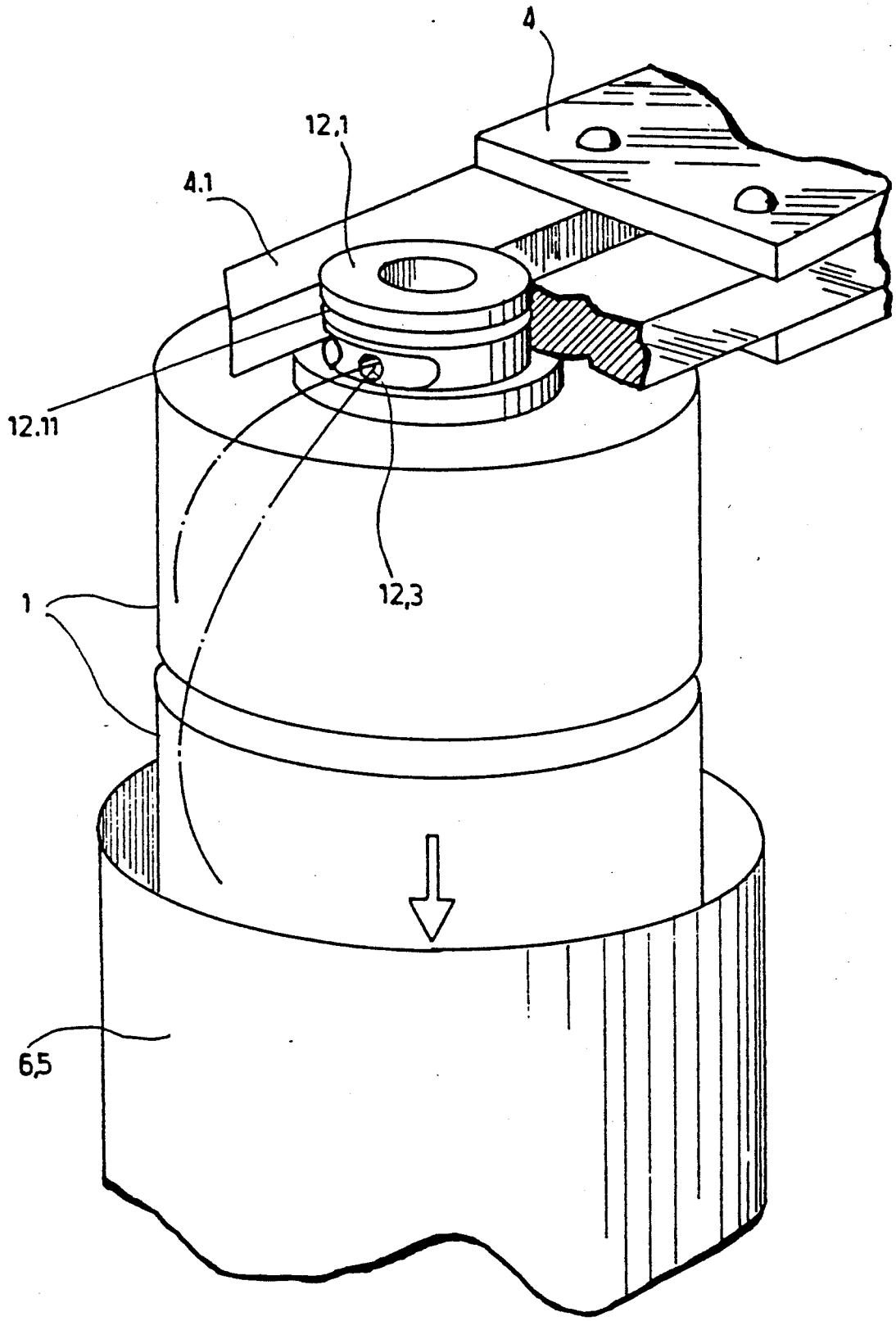
FIG. 6 is a perspective, partial view of a set of yarn packages during its insertion into a two-for-one twisting spindle with a modified embodiment of a package transport adapter.
Figure 7:
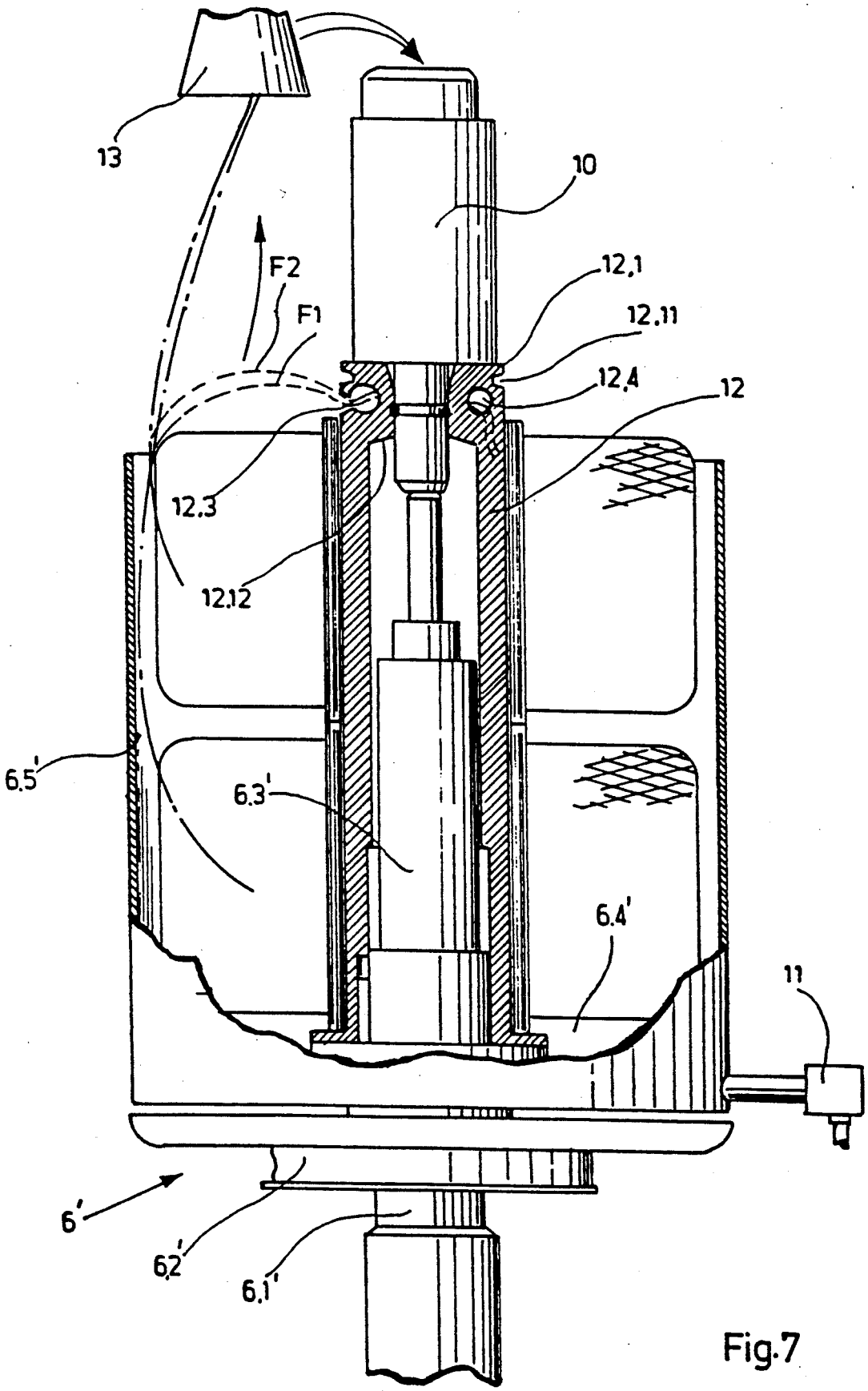
FIG. 7 is a side view, partially cut of the set of yarn packages of FIG. 6 after its insertion into a two-for-one twisting spindle.
Figure 8:
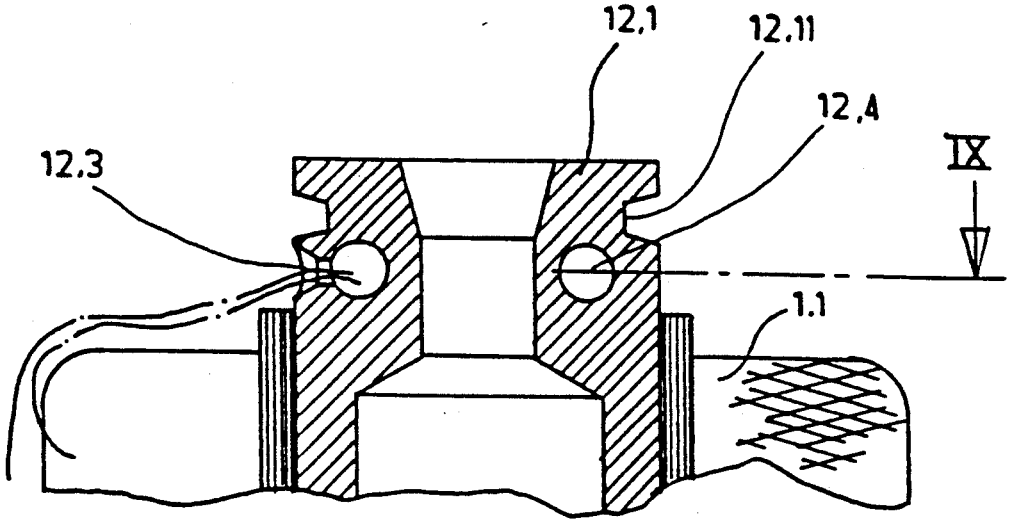
FIG. 8 is an enlarged side view of the head of FIG. 7 of the package transport adapter shown in FIGS. 6 and 7 and used to hold the set of packages.
Figure 9:
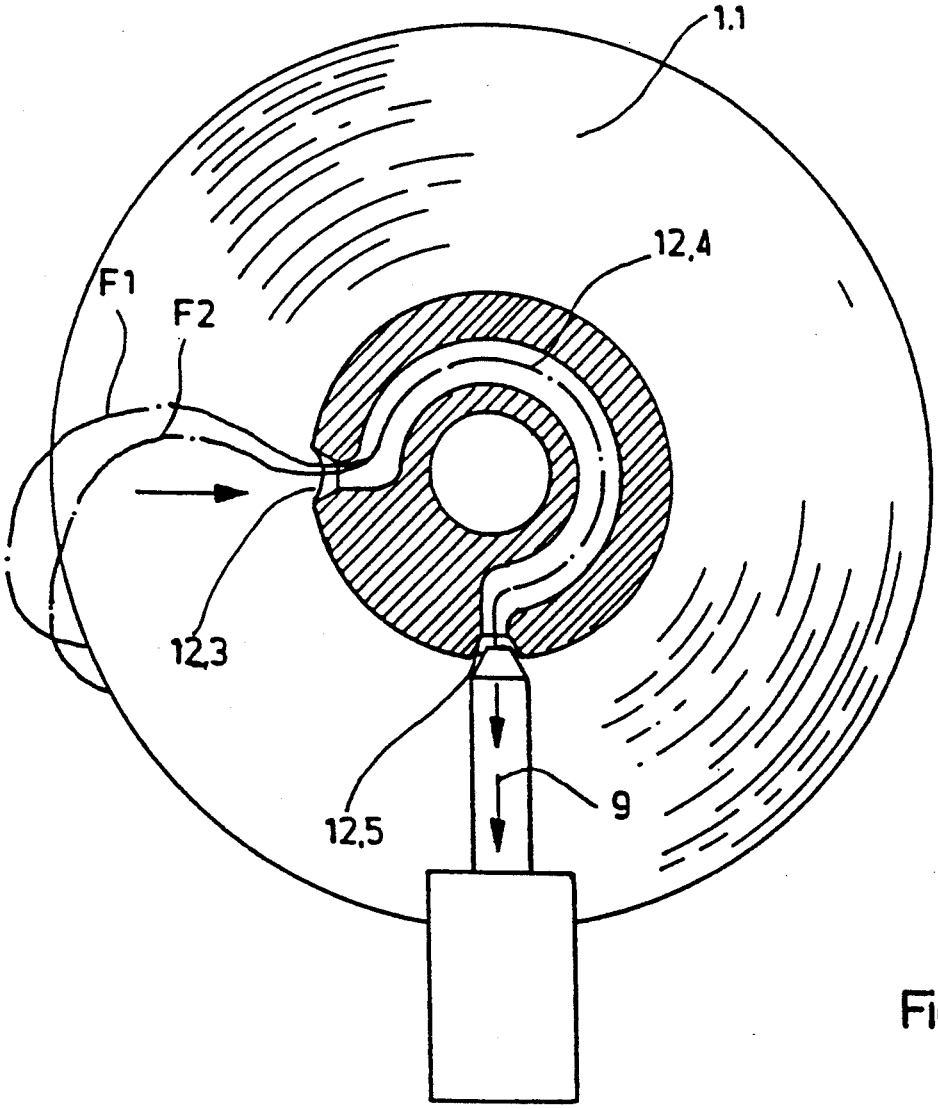
FIG. 9 is a sectional view along the line VIII of FIG. 8.

With reference to FIG. 5, the following will describe the transportation of a set of yarn packages 1 from a preparatory station in a somewhat different embodiment of a conveying system.

In this Figure, the conveying system 7 comprises guide tracks 7.1, along which transport plates 7.3 travel, Which carry a hollow pin 7.2 on their upper side. For their movement along the tracks 7.1, the transport plates are driven on their underside by means of a round cord drive 7.4. In comparison with an overhead conveyor the advantage of the conveying system 7 is that it can be incorporated in a transport flow with due consideration of the spacing. The conveying system also allows a very simple switch construction, so that transport flows can be bypassed very rapidly, for example, in the case of repeated operations or in standby positions.

For the transportation of a set of packages, 1, the adapter 2 is creeled on the hollow pin 7.2 of transport plate 7.3. The transport plate traveling along the tracks 7.1 enters into a preparatory device 8 comprising a means 8.1 which slightly raises the transport plate 7.3, thereby disengaging same from the round cord drive 7.4. A friction wheel drive 8.3 contacts the outer surface of transport plate 7.3, thereby putting the latter into rotation. A brush 8.5 and a suction device 8.6 grasp the yarn ends F1 and F2 and guide same over the upper end of the head piece 2.1 on package transport adapter 2. A rotatably supported suction nozzle 8.4 facing the means 8.1 moves to the lower end of the hollow pin 7.2 in the transport plate 7.3, and causes the yarn ends F1 and F2 to enter into the interior of adapter 2, as shown in FIG. 5, where they are held during the entire transportation.

The set of packages 1 can then be removed from the conveying system 7 and inserted into a two-for-one twisting spindle 6 by means of a gripper 4, as has been described with reference to FIG. 4.

The following will now describe with reference to FIGS. 6–12 that it can be advantageous to design and construct the adapter for transporting packages such that the yarn ends need not be inserted over the upper edge of the head piece on the adapter. Such package transport adapters have the advantage that yarn unwinding aids or yarn finishing devices, which must be placed as an additional adapter head on top of the head piece on the package adapter, are not impeded by the yarn ends to be stored in the central bore of the adapter. In the case of a package transport adapter as has been described with reference to FIGS. 1–5, it is necessary, before adding such an additional adapter head, for example for a better yarn entry, to first remove the yarn ends from the central bore by means of a handling device or gripper, before such an adapter head can be added.

To describe a differently designed package transport adapter 12, reference is made to FIGS. 6–9, which illustrate a set of yarn packages 1 inserted into a two-for-one twisting spindle 6' comprising a whorl 6.1', a rotating plate 6.2', a pot 6.5' and a pot bottom 6.4' with a hollow pin 6.3'. Arranged in the interior of the hollow pin 6.3' is an injector not shown, which can be connected in a known manner per se to an external source of compressed air 11.

The package transport adapter 12 is provided with a flange 12.2 at its lower end and a head piece 12.1 at its upper end. As aforesaid, the head piece is provided on its outer surface with a groove 12.11 for engagement with the gripping member 4.1 of gripper 4. Likewise as already described, the head piece is further provided on its inner side with an inwardly directed projection 12.12 for engagement with the coupling member of an overhead conveyor.

In this embodiment of a package transport adapter, the yarn ends F1 and F2 are not inserted over the upper edge of the head piece 12.1 into the interior of the tubular adapter. Rather, they enter through an inlet opening 12.3 in the outer surface of the head 12.1 into a yarn entry channel 12.4, which extends in the circumferential direction of the head 12.1 over an angle of approximately 270°, the one end of said channel being connected with the inlet opening 12.3 and the other with a second opening 12.5, to which a suction nozzle 9 can be applied.

After having been inserted into the two-for-one twisting spindle 6', a yarn unwinding head 10 is placed on the transport adapter 12. A gripping device 13 picks up the yarn ends shown in dashed lines in FIG. 7, and moves same to the upper end of the yarn unwinding head 10, whence the air current caused by the injector inserts the yarn ends through the yarn unwinding head 10 and the transport adapter 12 directly into the spindle.

Figure 10:
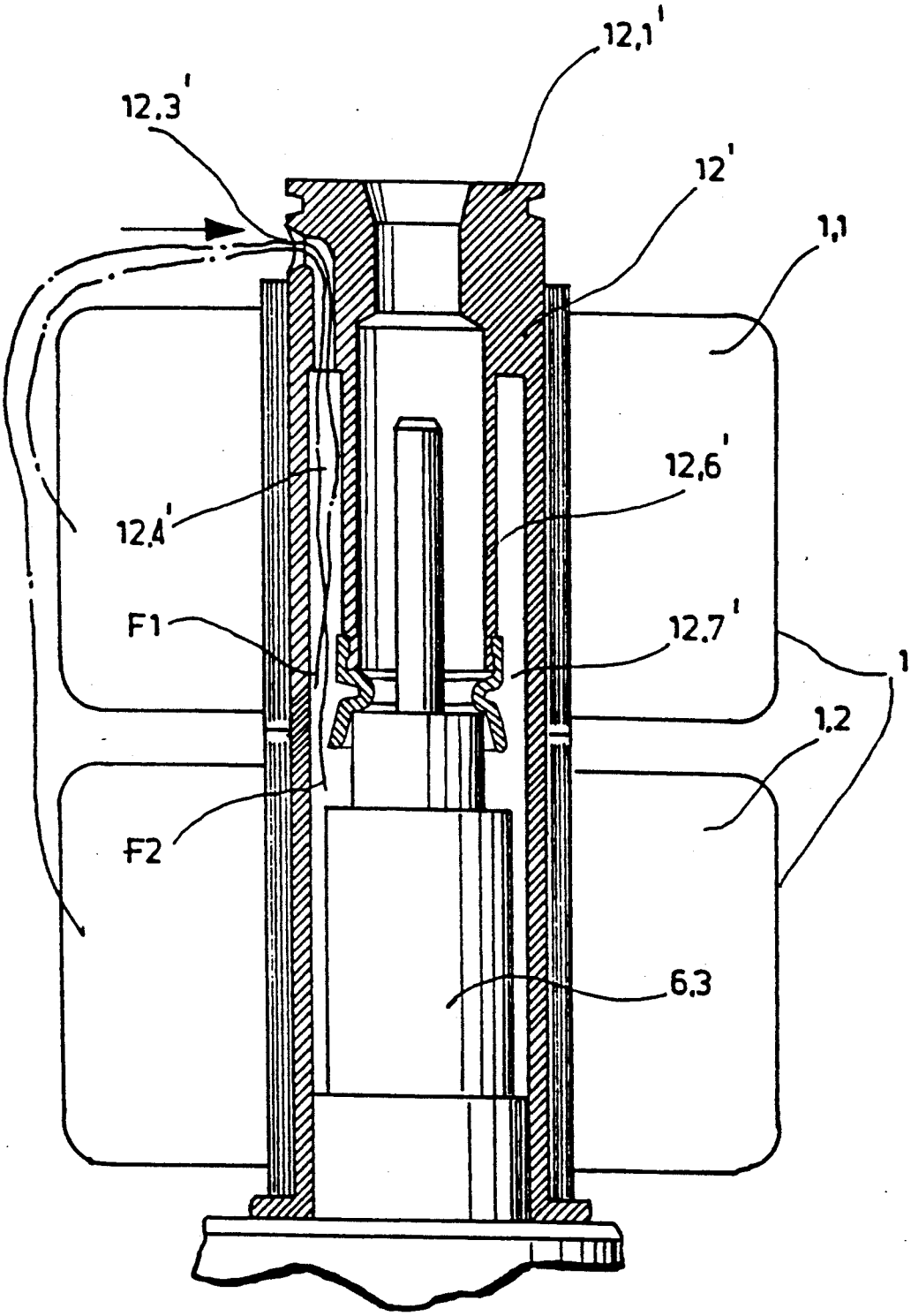
FIG. 10 is a side view partially cut, of a set of yarn packages interconnected by another type of adapter for transporting the packages.

In another embodiment illustrated in FIG. 10, a transport adapter 12' combining the packages to a stack 1, the yarn ends enter by suction through an inlet opening 12.3' and a yarn entry channel 12.4' into a space between the outer tube of the package transport adapter 12' and an inner tube 12.6'. The inner tube having been inserted into the two-for-one twisting spindle rests via an elastic sleeve 12.7' on the hollow pin 6.3 of the two-for-one twisting spindle. The sleeve 12.7' serves to seal the interior of the bobbin transport adapter, when the yarn is threaded by air through the two-for-one twisting spindle, it being necessary to ensure that the operation is not interfered with by the action of external air.

Figure 11:
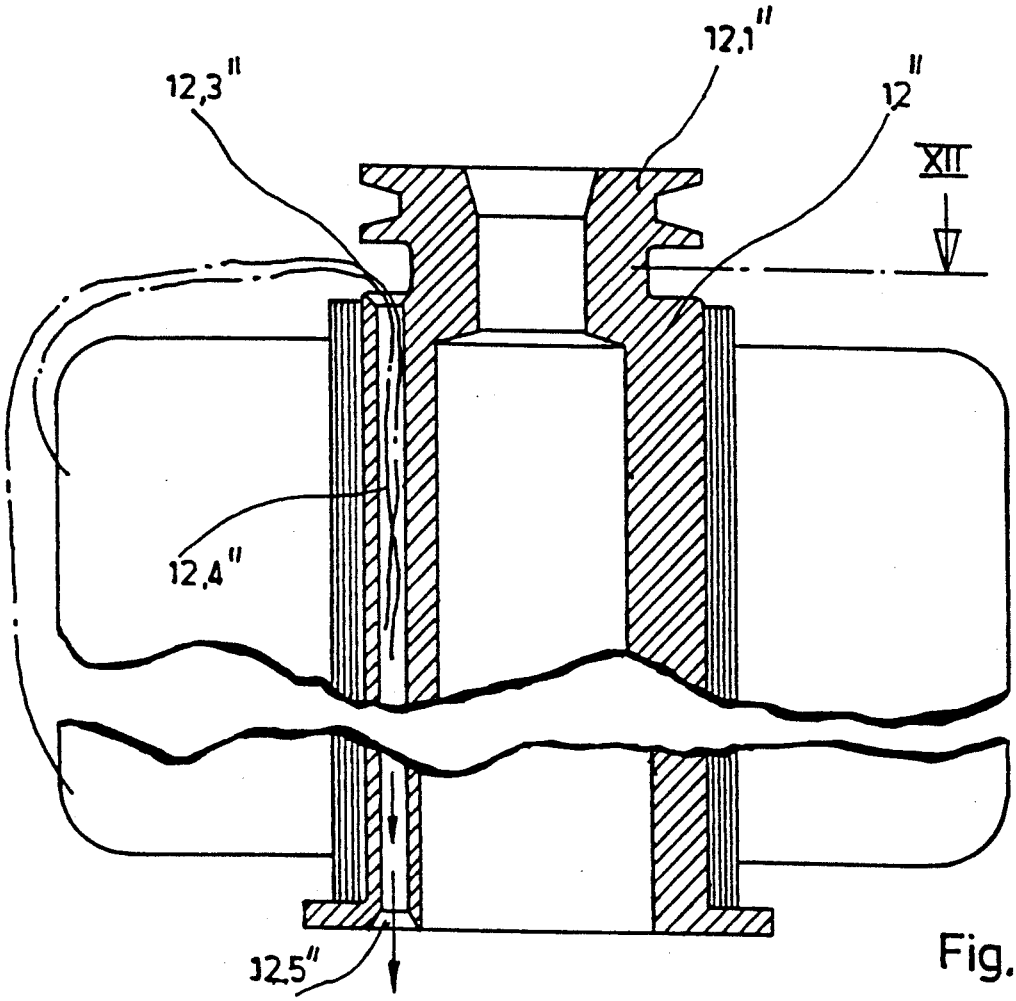
FIG. 11 is a view of a set of packages interconnected by yet another type of adapter for transporting the packages.
Figure 12:
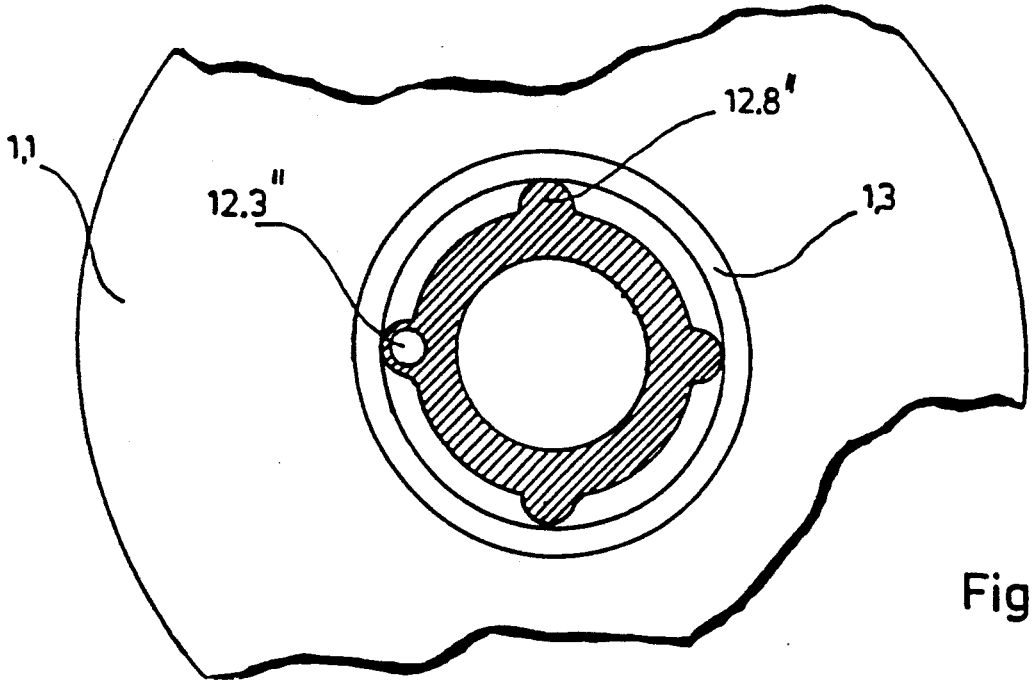
FIG. 12 is a sectional view along the line XII of FIG. 11.

Yet another embodiment of an adapter 12'' combining the packages to a stack 1 is shown in FIGS. 11 and 12. A head 12.1'' of the adapter 12'' is designed and constructed as described hereinabove. The adapter 12'' is provided on its outside with centering ribs 12.8''. Arranged in one of these centering ribs is a yarn entry channel 12.4'', which has an inlet opening 12.3'', on its upper end and a suction opening 12.5'' at its lower end.

Also this embodiment allows an easy addition of a yarn unwinding head after the set of yarn packages is inserted into a two-for-one twisting spindle.

What is claimed is:

1. Method of transporting to and positioning a set of at least two yarn packages in a spindle assembly of a twister textile yarn processing machine while maintaining the yarn ends of the packages in desired locations; said method comprising the steps of:

creeling at a preparatory station at least two yarn packages on a tubular adapter device having at its upper end a gripping head;

positioning the yarn ends of the packages in the interior of the adapter device at the preparatory station by introducing the yarn ends into a channel extending inwardly from an outside surface of the adapter device near the top thereof and through a wall of the adapter device;

conveying the adapter device and yarn packages by a conveyor mechanism to a desired spindle assembly of a twister;

gripping the adapter device with a gripper device, moving the adapter device and yarn packages from the conveyor mechanism and placing the adapter device and yarn packages on the spindle of the spindle assembly of the twister; and threading the yarn ends from the interior of the adapter device through the spindle assembly for processing the yarn as it is withdrawn from the packages on the adapter device.

2. Method of transporting to and positioning a set of at least two yarn packages in a spindle assembly of a twister textile yarn processing machine while maintaining the yarn ends of the package in defined fixed locations; said method comprising the steps of:

creeling at a preparatory station at least two yarn packages on a tubular adapter device having at its upper end a gripping head adapted for receiving a gripper device, a conveyor holder device and yarn handling devices;

positioning the yarn ends of the packages in the interior of the adapter device at the preparatory station by introducing the yarn ends into a channel extending inwardly from an outside surface of the adapter device near the top thereof and through a wall of the adapter device;

gripping the adapter device with a first gripper device, moving the adapter device and yarn packages from the preparatory station, and placing the adapter device and yarn packages on a holder device of a conveyor mechanism;

conveying the adapter device and yarn packages by a conveyor mechanism to a desired spindle assembly of a twister;

gripping the adapter device with a second gripper device, moving the adapter device and yarn packages from the conveyor mechanism and placing the adapter device and yarn packages on the spindle of the spindle assembly of the twister; and threading the yarn ends from the interior of the adapter device through the spindle assembly for processing the yarn as it is withdrawn from the packages on the adapter device.

3. Method of transporting to and positioning a set of at least two yarn packages in a spindle assembly of a twister textile yarn processing machine while maintaining the yarn ends of the packages in defined locations; said method comprising the steps of:

creeling at a preparatory station at least two yarn packages on a tubular adapter device having at its upper end a gripping head and removably positioned at its lower end on an upstanding pin of a transport plate movably carried in conveyor mechanism;

positioning the yarn ends of the packages in the interior of the adapter device at the preparatory station by introducing the yarn ends into a channel extending inwardly from an outside surface of the adapter device near the top thereof and through a wall of the adapter device;

conveying the adapter device and yarn packages by a conveyor mechanism to a desired spindle assembly of a twister;

gripping the adapter device with a gripper device, moving the adapter device and yarn packages from the conveyor mechanism and placing the adapter device and yarn packages on the spindle of the spindle assembly of the twister; and threading the yarn ends from the interior of the adapter device through the spindle assembly for processing the yarn as it is withdrawn from the packages of the adapter device.

4. Method, as set forth in claim 1, 2 or 3, in which said step of positioning the yarn ends of the packages in the interior of the adapter device at the preparatory station further includes introducing the yarn ends into a channel extending from the outside surface of the adapter device near the top thereof and circumferentially through the wall of the adapter device.

5. Method, as set forth in claim 1, 2 or 3, in which said step of positioning the yarn ends of the packages in the interior of the adapter device at the preparatory station further includes introducing the yarn ends into a channel extending inwardly from the outside surface of the adapter device near the top thereof and downwardly through the wall of the adapter device.

6. An adapter device for mounting at least two packages of textile yarn for preparatory processing, transporting and mounting in a spindle assembly of a twister yarn processing machine; said adapter device comprising a tubular body portion open on both ends and being of sufficient length for receiving at least two superimposed yarn packages, an outwardly extending flange portion on a lower end of said body portion for supporting the yarn packages, and a head piece forming an upper end of said body portion and having a groove extending circumferentially around an outer surface thereof for being gripped by a gripper device, said head piece including an opening in a side wall thereof for inserting the free end of the yarn packages into the interior of said adapter device.

7. An adapter device, as set forth in claim 6, in which said head piece comprises an inwardly directed projection on the interior surface thereof for engagement with a coupling member of a suspension holder of a transporting conveyor mechanism.

8. An adapter, as set forth in claim 6 or 7, in which there is further provided a yarn channel extending from said yarn entry opening in the side wall of said head piece and in a circumferential direction of the wall over a predetermined angle of the circumference of said body portion, and a second opening in the side wall of said body portion and connecting with said yarn channel for receiving a suction nozzle when threading of the yarn ends therethrough is desired.

9. An adapter, as set forth in claim 6 or 31, further including a yarn channel extending from said yarn entry opening in the side wall of said body portion and extending downwardly in the wall of said head piece and terminating in the interior of said tubular body portion.

10. An adapter, according to claim 6 or 7, further including a yarn channel extending from said yarn entry opening in the side wall of said body portion in the longitudinal direction of the wall of said body portion downwardly over the entire length of said body portion, and a second opening in the lower end of said body portion for receiving a suction nozzle to apply a suction to said yarn channel when threading of the yarn ends therethrough is desired.

* * * * *

UNITED STATES PATENT AND TRADEMARK OFFICE

CERTIFICATE OF CORRECTION

PATENT NO. : 5,207,052

DATED : May 4, 1993

INVENTOR(S) : Heinz Fink and Heinz Stenmans

It is certified that error appears in the above-identified patent and that said Letters Patent is hereby corrected as shown below:

Column 8, line 54, "31" should be -- 7 --.

Signed and Sealed this

Eleventh Day of January, 1994

*Attest:*

*Attesting Officer*

BRUCE LEHMAN

*Commissioner of Patents and Trademarks*